US005832891A

United States Patent [19]

Paul

[11] Patent Number: 5,832,891

[45] Date of Patent: Nov. 10, 1998

[54] VALVE GEAR MECHANISM FOR A MULTI-CYLINDER INTERNAL COMBUSTION ENGINE

[75] Inventor: Michael Paul, Bad Friedrichshall, Germany

[73] Assignee: Audi A.G., Ingolstadt, Germany

[21] Appl. No.: 632,500

[22] PCT Filed: Sep. 26, 1994

[86] PCT No.: PCT/EP94/03213

§ 371 Date: May 10, 1996

§ 102(e) Date: May 10, 1996

[87] PCT Pub. No.: WO95/10694

PCT Pub. Date: Apr. 20, 1995

[30] Foreign Application Priority Data

Oct. 14, 1993 [DE] Germany ..... 43 34 995.1

[51] Int. Cl.[6] ..... F02B 77/00

[52] U.S. Cl. ..... 123/198 F; 123/90.16

[58] Field of Search ..... 123/198 F, 90.16

[56] References Cited

U.S. PATENT DOCUMENTS 5,150,675 9/1992 Murata ..... 123/193.5

FOREIGN PATENT DOCUMENTS

| | | |
|---|---|---|
| 0259106 | 3/1988 | European Pat. Off. . |
| 0276533 | 8/1988 | European Pat. Off. . |
| 3739246 | 6/1988 | Germany . |
| 4205230 | 8/1993 | Germany . |
| 4017705 | 1/1992 | Japan . |
| 2199079 | 6/1988 | United Kingdom . |

*Primary Examiner*—Noah P. Kamen
*Attorney, Agent, or Firm*—Lalos & Keegan

[57] ABSTRACT

In a valve gear-mechanism for a multi-cylinder internal combustion engine, the inlet valves (E1, E2) are actuated optionally by first cams on a camshaft via first finger levers (7) or by second cams via second finger levers (9), the first and second finger levers being separate or linked together by coupling pins (13) to which a pressure medium can be applied via a longitudinal channel (15) in the finger lever shaft. In order to be able to cut individual cylinders out, the first cams allocated to the inlet valves (E1) of the cylinder concerned have a zero-lift contour and in the longitudinal channel (15) there is a sealed section (15*a*) allocated to one of said valves (E1) which can individually be connected to a source of pressure medium so that, when the supply of pressure medium is interrupted, the inlet valves of said cylinder are stopped and, on connection to the source of pressure medium, the inlet valves are actuated in accordance with the contour of the second cam.

5 Claims, 5 Drawing Sheets

VALVE GEAR MECHANISM FOR A MULTI-CYLINDER INTERNAL COMBUSTION ENGINE

FIELD OF THE INVENTION

The invention relates to a valve gear mechanism for a multicylinder internal combustion engine. A valve gear mechanism such as this is known, for example, from EP 213 759 or DE 42 05 230.

SUMMARY OF THE INVENTION

The object of the invention is to employ simple means to develop improved cylinder disengagement. The object of the present invention for the sake of fuel conservation in a multicylinder internal combustion engine with a generic valve gear mechanism.

In the present invention, a particular cylinder is disengaged by shutting down its inlet valve or inlet valves. Cylinder disengagement is accomplished using a zero-pitch cam profile, a profile consisting exclusively of a base circle, on the first cams acting on the valves associated by way of the first rocker arms to the cylinder to be disengaged. Pressure means or cam lobes, therefore, do not act on the coupling pins, so that no coupling of these first rocker arms with the second rocker arm or arms takes place. Rocker arms normally interact with a cam having a profile which secures the desired valve control time and the desired valve lift.

The section of the longitudinal channel associated with the first rocker arm of the inlet valve of the cylinder to be disengaged may be sealed by plugs. One of such plugs may have a pressure oil delivery bore leading to the sealed section, which bore may be connected to a high-pressure source by means of an on-off valve actuatable on the basis of operating parameters. No pressure or only reduced pressure is present in the sealed channel section when the valve is closed, so that the first rocker arm, and with it the pertinent inlet valve, remain at rest. If the sealed channel section is supplied with high-pressure liquid by opening the on-off valve, the coupling pin moves into its coupling position, in which it connects the first rocker arm to the second rocker arm, thereby actuating the inlet valve as determined by the profile of the cam operating in conjunction with the second rocker arm. The plug with the pressure means delivery bore is mounted preferably in the area of a bearing point of the shaft in the cylinder head of the internal combustion engine, so that the on-off valve may be mounted on the bearing point.

If several inlet valves are provided for each cylinder, the camshaft for all inlet valves of at least one cylinder is provided with a first cam with zero-lift profile. A sealed section is provided in the longitudinal channel associated with these several inlet valves, one of which has a pressure means supply of its own. By the process described above therefore, no coupling occurs between the first and second rocker arms at zero pressure or reduced pressure and the inlet valves are shut off, while the first and second rocker arms are coupled when pressure is applied and the inlet valves are actuated as determined by the profile of the second cam or cams.

When several inlet valves per cylinder are installed for at least one cylinder and it is desired (a) to shut off all inlet valves, (b) to activate one valve or some but not all valves, (c) to activate all valves, two longitudinal channels may be provided in the camshaft. The first longitudinal channel is connected to the bores receiving the coupling pins in a first rocker arm actuating the first set of valves. The second longitudinal channel is connected to the bores receiving the coupling pins in the first set of rocker arms actuating a second set of inlet valves. Both longitudinal channels may have a sealable section for the inlet valves of at least one cylinder, and these sections may be connected to or isolated from a high-pressure source. In addition, these sections may be sealed at least at one end by a slide valve movable on the basis of operating parameters. In a first position the slide valve isolates both longitudinal channels from the high-pressure source, in which case all inlet valves of the subject cylinder are shut off. In a second position, the slide valve connects one of the longitudinal channels to the high-pressure source, in which case the valve or valves which are associated with this section of the longitudinal channel are actuated on the basis of the profile of the second cam or cams. Finally, in a third position, the slide valve connects both longitudinal channels to the high-pressure source, in which case all inlet valves of the cylinder in question are actuated on the basis of the profile of the second cam or cams. If three inlet valves are provided, and accordingly three first rocker arms and two interconnected second rocker arms mounted between adjacent first rocker arms, as is illustrated in referenced DE 42 05 230, it may be preferable to connect one of the longitudinal channels to the bores receiving the coupling pins in the first rocker arms actuating the two outer inlet valves and the second longitudinal channel to the bore receiving the coupling pins in the first rocker arm actuating the center inlet valve. As a result, when pressure is applied to only one longitudinal channel, the load on the interconnected second rocker arm is balanced. Rocker arm levers may be coupled either to the first rocker arm positioned between them or to the two outer first rocker arms.

In each instance a channel should be provided in the slide valve, one of which is connected at all times both to a low-pressure source and to both longitudinal channels in order to ensure lubrication of the bearing points of the first and second rocker arms on the shaft.

BRIEF DESCRIPTION OF THE DRAWINGS

Two embodiments of the invention are described in what follows with reference to the drawings, in which.

DETAILED DESCRIPTION

Figure 1:
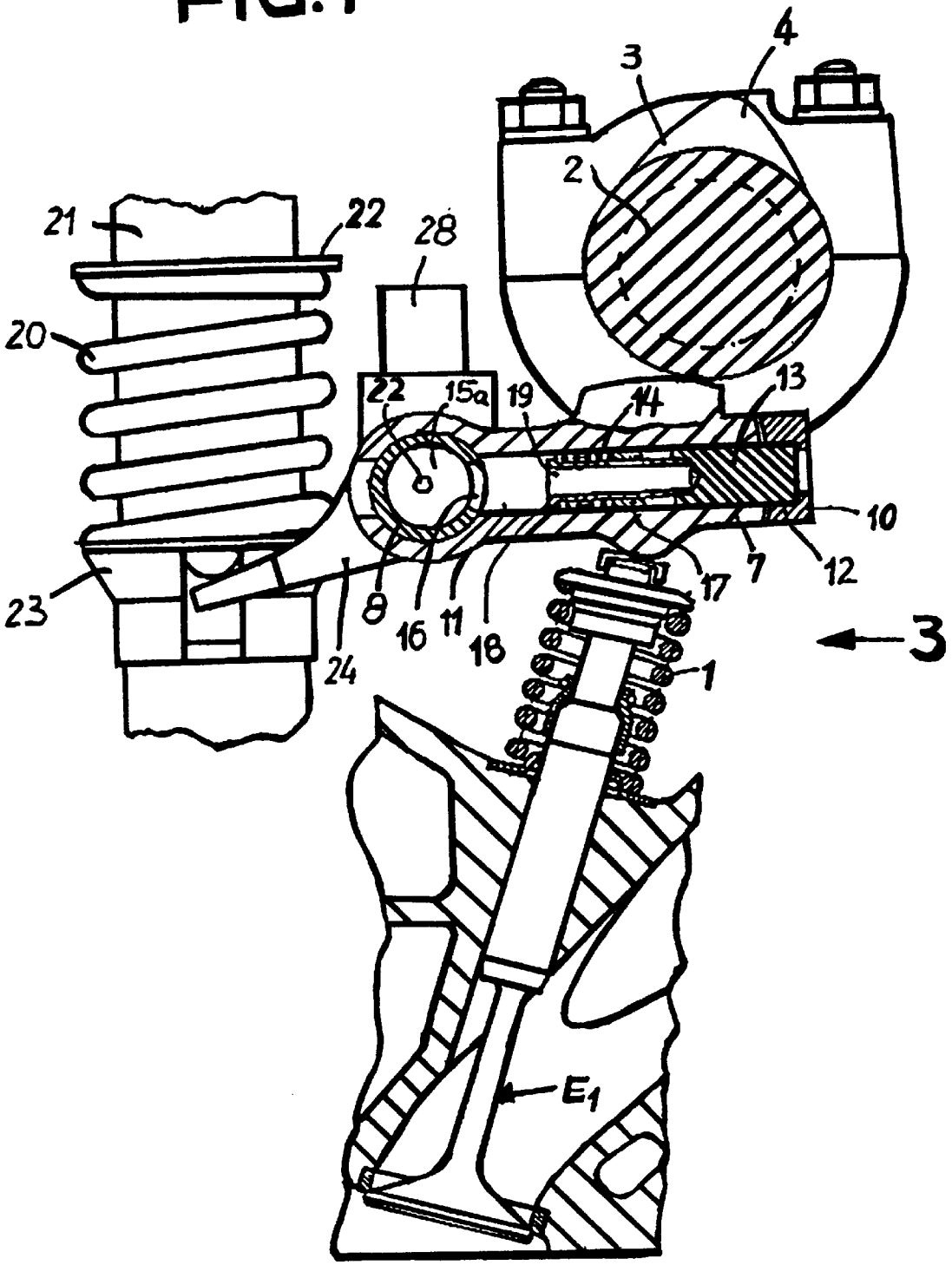
FIG. 1 is a diagram illustrating a view of a valve gear mechanism with a valve actuating mechanism according to the present invention in a vertical section along line 1—1 in FIG. 3.
Figure 2:
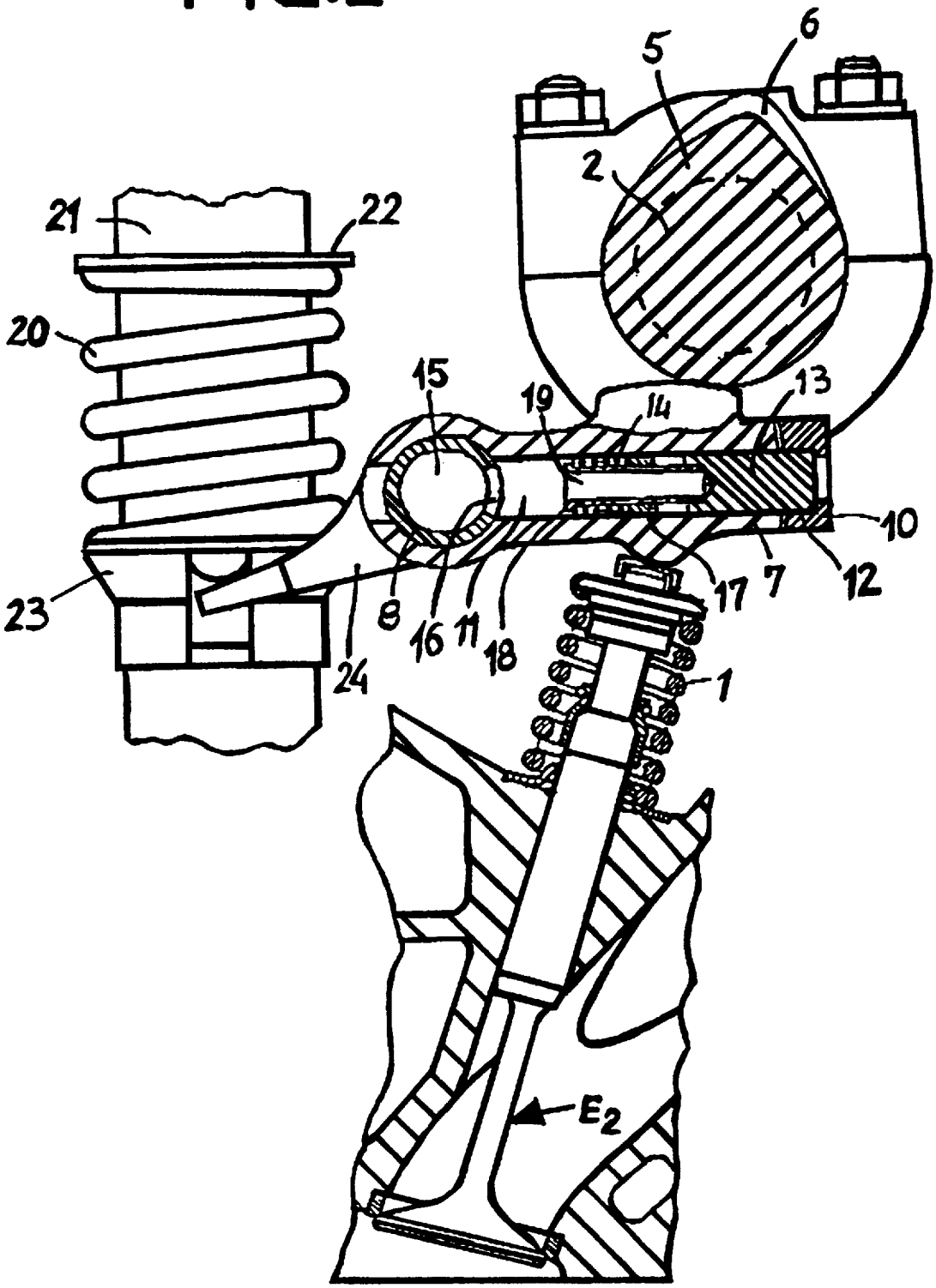
FIG. 2 is a diagram illustrating a view of a vertical section along line 2—2 in FIG. 3.
Figure 3:
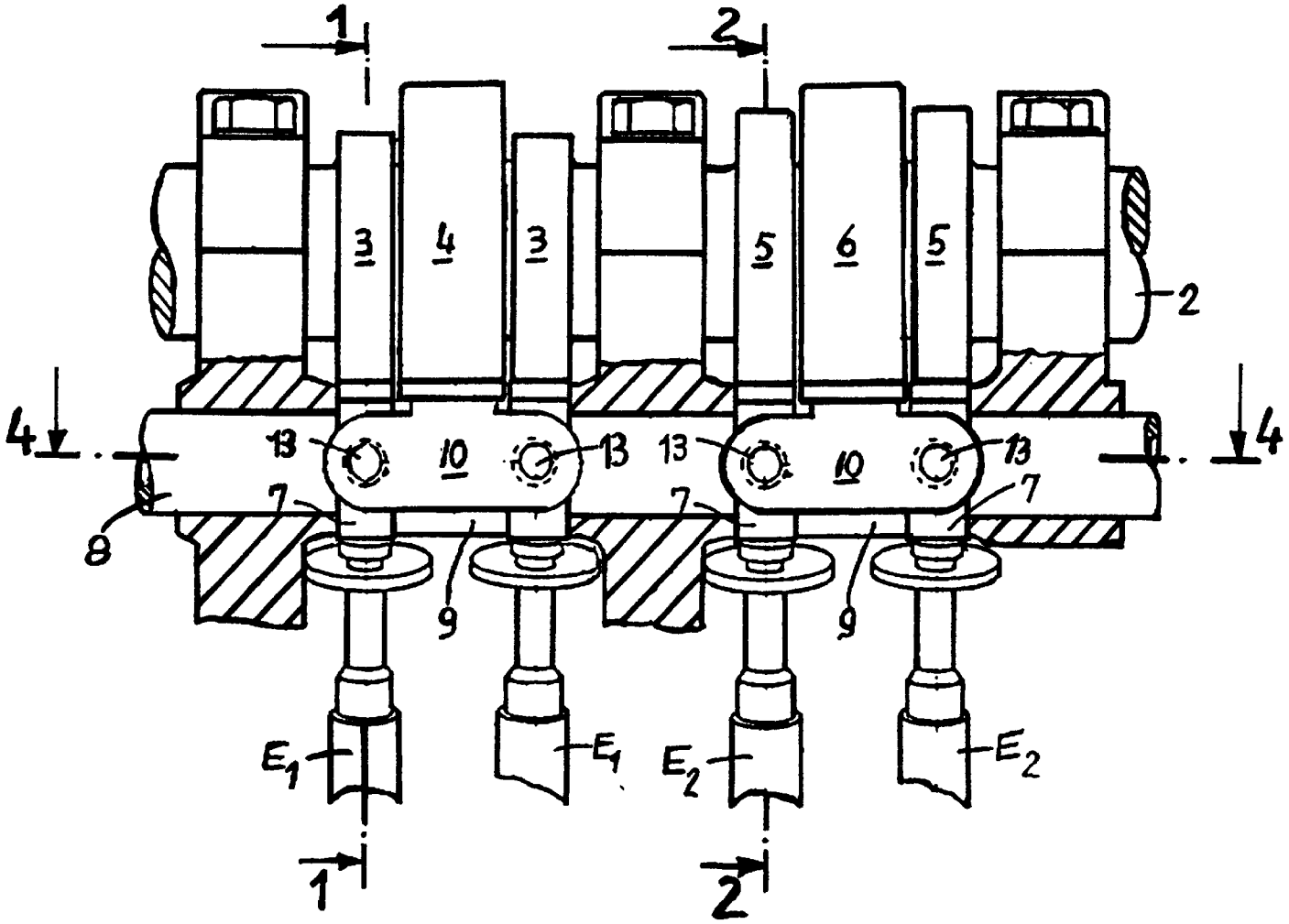
FIG. 3 is a diagram illustrating a view of the valve gear mechanism for the inlet valves of two cylinders in the direction of arrow 3 in FIG. 1.

FIGS. 1 through FIG. 4 illustrate a valve gear mechanism for two inlet valves E1 of a first cylinder and two inlet valves E2 of a second cylinder of a multicylinder internal combustion engine. A spring 1 applies a load on each valve E1, E2 in the direction of closing. For the valves E1 a first set of cams 3 with zero-lift profile is mounted on a camshaft 2, and between these cams a second cam 4 with a cam profile corresponding to the valve lift desired. In a similar manner, a first set of cams 5 with a cam profile designed for the lower engine speed range are provided, and between these cams a second cam 6 with a cam profile designed for the upper engine speed range. Cams 4 and 6 preferably have the same profile. A first rocker arm 7 is provided for both valves E1 and valves E2, this rocker arm 7 being mounted respectively between valve E1 and cam 3 and between valve E2 and cam 5. All first rocker arms 7 are rotatively mounted on a common shaft 8. Between the first rocker arms 7 of each valve pair E1 or E2 there is mounted on the shaft 8 a second rocker arm 9 which operates in conjunction with the second cam 4 or 6. Every second rocker arm 9 may be coupled in the upper engine speed range to the adjacent first rocker arms 7, so that in this engine speed range the valves E1 are actuated by the profile of cam 6. The free end of every second rocker arm 9 is provided with a crosspiece 10 which extends in front of and a small distance from the free ends of the first rocker arms 7. Bores 11 are provided which extend radially to the axis of rotation 8 and which are in alignment with bores 12 in the crosspiece 10 when the valves are in their closed position. In each bore 11 there is mounted a piston 13 which is movable between a first inner position (FIG. 4) and a second outer position (FIGS. 1, 2), in which it extends into the appropriate bore 12 in the crosspiece 10. Thus, in the second position the pistons 13 connect the first rocker arms 7 to the second rocker arms 9, so that the valves E1 are actuated as determined by the profile of cam 4 and the second inlet valves E2 as determined by the profile of cam 6.

The pistons 13 are displaced outward by a pressure means which is delivered through a channel 15 in the shaft 8, which channel is connected to the bores 11 by way of openings 16 in the wall of the shaft 8. If delivery of the pressure means is interrupted, that is, if the pressure is reduced, the pistons 13 are each returned to their bores 11 by a spring 14, so that the second rocker arms 9 may now swing free and the valves E1 remain closed because of the zero-lift profile of their first cams 3, while valves E2 are actuated by the profile of cams 5. The spring 14 rests on one side on an insert 17 stationary in bore 11 and on the other on the end 18 of a pipe 19 which is fastened on the piston 13 and extends through the insert 17.

The second rocker arms 9 are held against their cam 4 or 6 by a spring 20. The springs 20 are each mounted on a pipe 21 receiving a spark plug or an injection valve and rest on one side on a stationary support 22 and on the other on a movable spring retainer 23 which operates in conjunction with the extensions 24 of the second rocker arm 9 partly enclosing the pipe 21.

Figure 4:
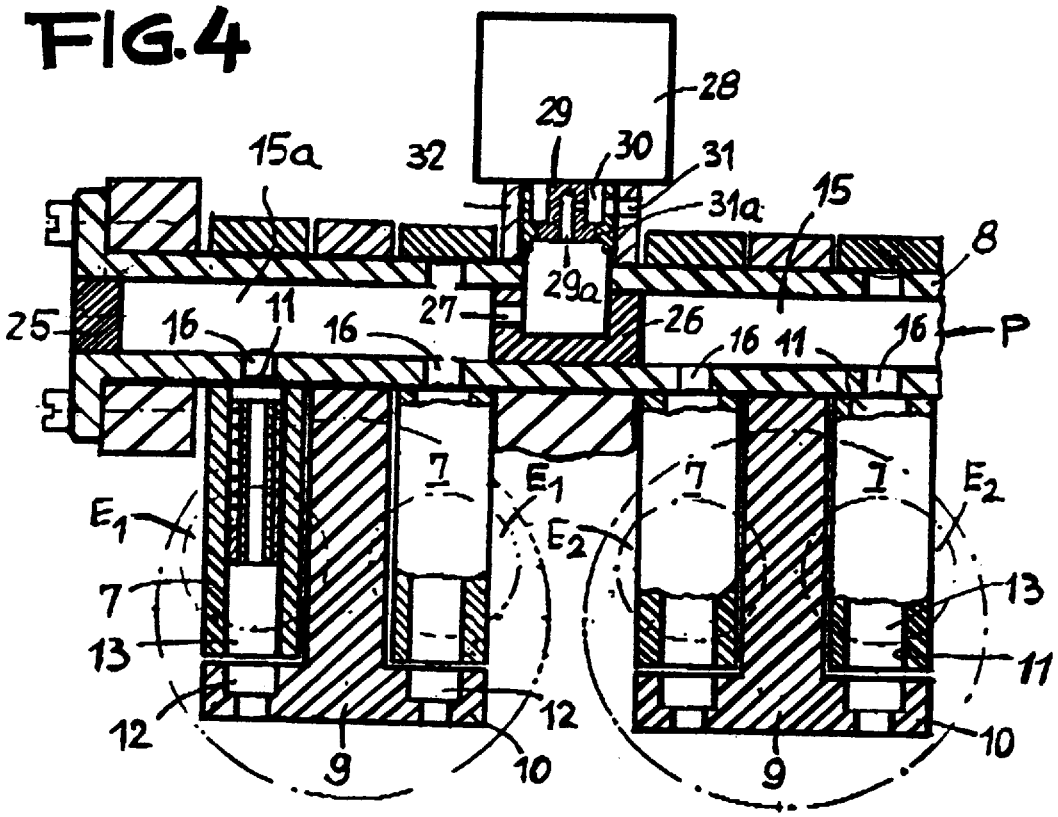
FIG. 4 is a diagram illustrating a sectional view along line 4—4 in FIG. 3, except that the left first rocker arm is entirely cut away.

As has been noted, the first cams 3 for the inlet valves E1 of a cylinder are provided with a zero-lift profile in order to shut off these valves and thus disengage the corresponding cylinder. For this purpose there is provided in the longitudinal channel 15 of the shaft 8 a sealed section 15*a* associated with these valves E1 and having its own supply of pressure means. If no pressure means or pressure means under reduced pressure are delivered to the section 15*a*, the coupling pins 13 remain in their uncoupled position as shown in FIG. 4 and the valves E1 in their closed position, since the first cams 3 have a zero-lift profile. The second rocker arm 9 swings free as a result of its actuation by the second cam 4. If a pressure means is delivered to section 15*a*, the coupling pins 13 are moved into the position shown in FIG. 1 and couple the first rocker arms 7 to the second rocker arm 9, as a result of which the valves E1 are actuated as determined by the profile of cam 4.

The channel section 15*a* is sealed by plugs 25 and 26 inserted into the longitudinal channel 15. A pressure means delivery bore 27 ending in channel section 15*a* is made in plug 26, which bore may be connected to a pressure means source not shown by an electromagnetic on-off valve 28 on the basis of operating parameters. Plug 26 is mounted in the area of a bearing point 32 of the shaft 8 in the cylinder head, so that the on-off valve 28 may be mounted on this bearing point. The on-off valve 28 has a valve body 29 having a wide circumferential groove 30 communicating with a delivery bore 31 in the housing of the on-off valve and in the bearing point 32 which is connected to the pressure means source. The lower end of the valve body 29 operates in conjunction with a valve seat 31*a*. In the closed position of the valve body 29, delivery of pressure means to channel section 15*a* is blocked and the coupling pins 13 are accordingly in their uncoupling position.

The coupling pins 13 associated with the inlet valves E2 are in their uncoupling position shown in FIG. 4 when no pressure or only reduced pressure is present in the longitudinal channel 15. The inlet valves E2 are then actuated by the first cams 5 through the first rocker arms 7. If a pressure means under high pressure is delivered to the longitudinal channel 15 as indicated by the arrow P through an on-off valve not shown, the coupling pins 13 move into the coupling position shown in FIG. 2, in which position they connect the first rocker arms 7 to the second rocker arm 9, as a result of which the valves E2 are actuated as determined by the profile of the cam 6.

In order to ensure lubrication of the rocker arm bearing on the shaft 8 with the on-off valve 28 closed, a channel 29*a* is provided in the valve body 29 and is kept constantly in communication with channel section 15*a* and, by way of a throttle point with the circumferential groove 30.

In the embodiment illustrated, only the valves E1 of a cylinder can be shut off and this cylinder disengaged. However, the scope of the invention includes provision for the inlet valves of several cylinders of first cams with zero-lift profile and sealed channel sections 15*a*, which, as shown in FIG. 4, may be connected individually to a pressure means source. Consequently, either several cylinders may be disengaged simultaneously or another individual cylinder may be disengaged in order to prevent prolonged disengagement of a cylinder and the attendant cooling of the cylinder.

Figure 5:
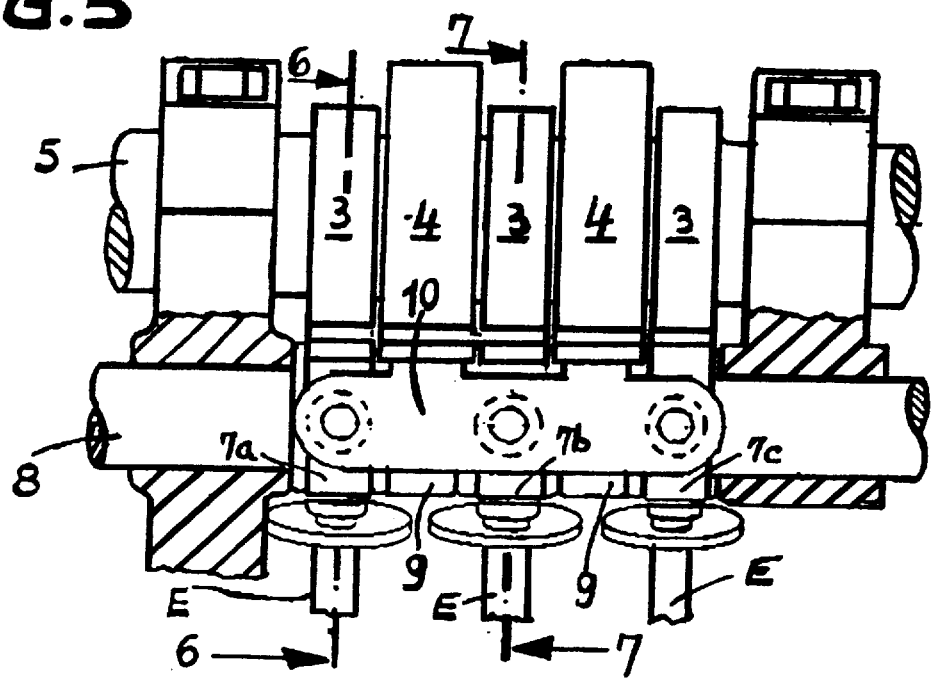
FIG. 5 is a diagram illustrating a view similar to that of FIG. 3 of a valve gear mechanism for three inlet valves of a cylinder.
Figure 6:
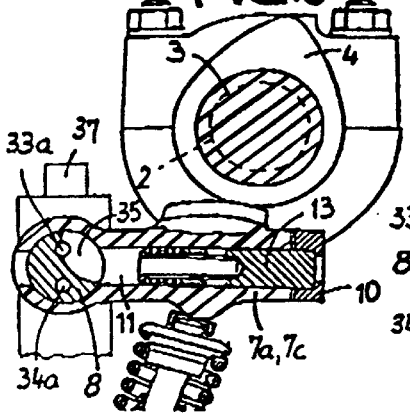
FIG. 6 is a diagram illustrating a sectional view along line 6—6 in FIG. 5.
Figure 7:
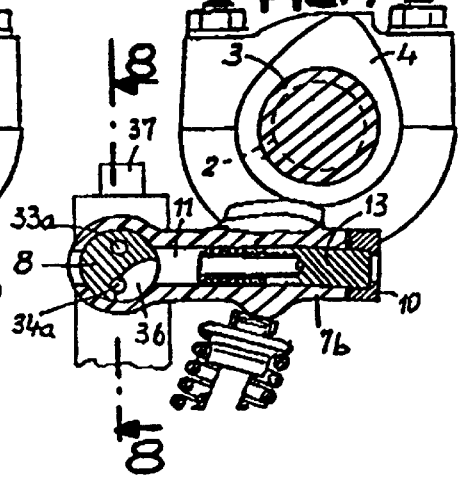
FIG. 7 is a diagram illustrating a sectional view along line 7—7 in FIG. 5, and FIGS. 8, 9, and 10 are diagrams illustrating sections along line 8—8 in FIG. 7 with an on-off valve in different positions.
Figure 8:
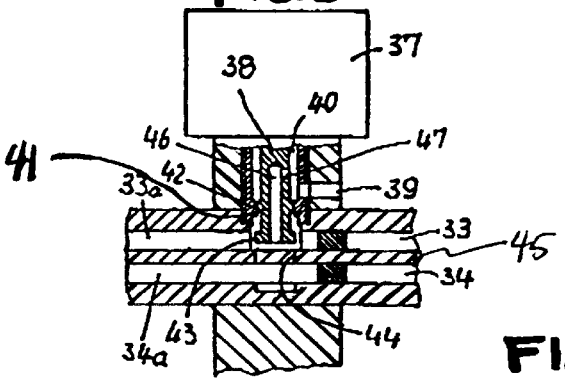

Reference is also now to be made to FIGS. 5 to 10, identical or similar elements being identified by the same reference numbers as in FIGS. 1 to 4. FIG. 5 shows a valve gear mechanism for three inlet valves E of a cylinder, a cam 3 with a zero-lift profile being associated with each valve and a cam 4 with a cam profile corresponding to the valve lift desired being mounted between each set of adjacent cams 3. As is the case in the first embodiment, a first rocker arm 7*a*, 7*b* or 7*c* is provided between each inlet valve E and its first cam 3, while a second set of rocker arms 9 whose free ends are connected by a crosspiece 10, which may be connected to the first rocker arms 7 by means of coupling pins 13 as described above, operate in conjunction with the second set of cams 4. The first set of rocker arms 7*a*, 7*b*, 7*c* and the second set of rocker arms 9, again, are mounted rotatively on a common shaft 8. The axis of rotation 8 could, as in the first embodiment, have a single longitudinal channel having, in the area of the rocker arms 7*a* to 7*c*, a sealed section which may be connected to a pressure means source of its own, so that all inlet valves E either are shut off or are actuated as determined by the profile of the second cams 4. It may be preferable, however, to be able to shut off the inlet valves of a cylinder individually or in groups. For this purpose, in the embodiment illustrated in FIGS. 5 to 10 there are provided in the rocker arm shaft 8 two longitudinal channels 33, 34 which in the area of one inlet valve group of at least one cylinder have sealed sections 33*a*, 34*a* and of which channel section 33*a* communicates by way of cutouts 35 in the shaft 8 with the bores 11 in the two outer rocker arms 7*a* and 7*c*, and channel section 34*a* by way of a cutout 36 with the bore 11 in the center rocker arm 7*b*. The channels 33 and 34 themselves may be connected by on-off valves not shown to a pressure means source, so that the following options are available:

(a) of connecting the center first rocker arm 7*b* only to the crosspiece 10 by delivery of pressure means to channel section 34*a*, as a result of which only the center inlet valve is actuated by the cam 4;

(b) of delivering pressure means to channel section 33*a* only, as a result of which only the two outer first rocker arms 7*a* and 7*c* are coupled to the crosspiece 10 and only the two outer inlet valves are actuated as determined by the profile of the cams 4; or (c) of supplying both channel sections 33*a* and 34*a* with pressure means, with the result that all first rocker arms 7*a*, 7*b*, and 7*c* are coupled to the crosspiece 10 and thus all inlet valves are actuated as determined by the profile of the cams 4.

Coupling only the two outer first rocker arms 7*a* and 7*c*, or only the center first rocker arm 7*b*, or all rocker arms 7*a*, 7*b*, and 7*c* to the crosspiece 10 prevents the load on the crosspiece 10 and the second rocker arms 9 from being unbalanced.

If none of the longitudinal channels 33, 34 is provided with pressure means, all coupling pins 13 remain in their uncoupling position, and accordingly all three inlet valves E are shut off.

Figure 9:
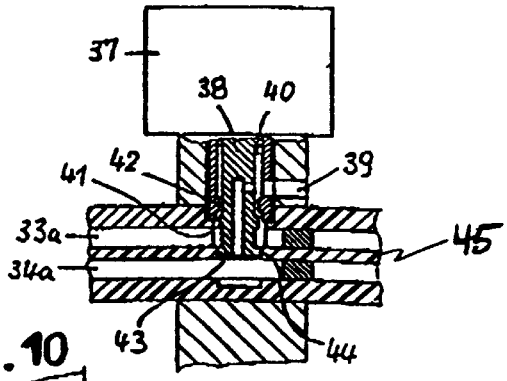

A simplified design was selected for the example illustrated, one in which either the center first rocker arm 7*b* only, or all three first rocker arms 7*a*, 7*b*, 7*c*, or either the two outer first rocker arms 7*a* and 7*c* only, or all first rocker arms may be coupled to the crosspiece 10. An electromagnetic on-off valve 37 is provided for this purpose at a bearing point of the shaft 8, the valve body 38 of which isolates a channel 39 connected to a high-pressure source in a first position (FIG. 8) from the two longitudinal channels 33, 34, and in a second position (FIG. 9) connects channel 39 to one channel section 33*a*, and in a third position (FIG. 10) also effects connection with the other channel section 34*a*. Consequently, when the controlling slide valve 38 is in the first position, all first rocker arms 7*a*, 7*b*, 7*c* are uncoupled from the crosspiece 10 and accordingly all inlet valves are closed. When it is in the second position, pressure is applied to the coupling pins 13 of the two outer first rocker arms 7*a*, 7*c*, so that the two outer inlet valves are actuated as determined by the profile of cams 4, while the center inlet valve remains closed. When it is in the third position, the center first rocker arms 7*b* are also coupled to the crosspiece, so that now all three inlet valves are actuated as determined by the profile of cams 4. The control slide valve is provided for this purpose with a longitudinal circumferential groove 40 which communicates at all times with the delivery channel 39. There is shaped on the end of the circumferential groove 40 a circular shoulder 41 which in the first position illustrated in FIG. 8 operates in conjunction with a circular valve seat 42. The lower end of the control slide valve 38 is in the form of a circular plate 43 which in the second position as illustrated in FIG. 9 blocks a circular opening 44 in the wall 45 between channel sections 33*a* and 34*a* and whose diameter is greater than the diameter of the shoulder 41. In this second position the circular shoulder 41 is lifted from the valve seat 42 and so the delivery channel 39 communicates with the channel section 33*a* by way of the circumferential groove 40. In the third position shown in FIG. 10, the control slide valve 38 is displaced downward through the opening 44, so that now the channel section 34*a* also communicates with the delivery channel 39. In order to ensure lubrication of the first rocker arms 7*a*, 7*b*, 7*c* and of the second rocker arms 9 on the shaft 8, if the control slide valve 38 is in its first position as illustrated in FIG. 9, a longitudinal channel 46 is provided in the control slide valve 38, which longitudinal channel is connected to the groove 40 by a throttle point 47, so that throttled pressure means delivery to both channel sections 33*a* and 34*a* takes place. Grooves through which a throttled flow of pressure means is delivered in the first position illustrated in FIG. 8 may be provided in the valve seat 42 or in the shoulder 41, in place of the longitudinal channel 46 and the throttle point 47.

Figure 10:
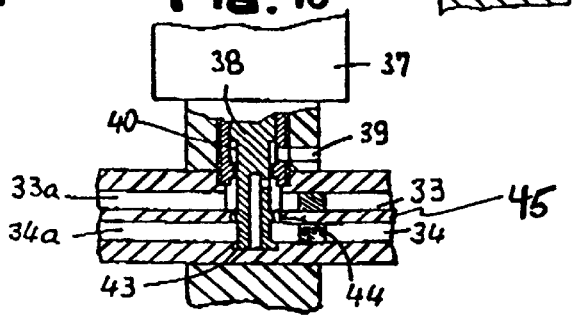

In the embodiment shown, when the control slide valve 38 is in the position illustrated in FIG. 9, the two outer inlet valves are actuated as determined by the profile of the second cams and when it is in the position illustrated in FIG. 10 all three inlet valves are actuated as determined by the profile of the second cams 4. The layout arrived at could, of course, also be such that the channel section 33*a* communicates with the bore 11 of the center first rocker arm 7*b* and the channel section 34*a* with the bores 11 of the two outer first rocker arms 7*a*. In this instance, then, with the control slide valve in the position illustrated in FIG. 9, only the center inlet valve would be actuated by the cams 9. In each case coupling of the two outer first rocker arms 7*a*, 7*c* only, or of the center first rocker arm 7*b* only, or of all three first rocker arms 7*a*, 7*b*, 7*c* to the crosspiece results in application of a balanced load to the crosspiece.

The present invention is not restricted to the embodiments presented; it may also be applied in a valve gear mechanism for an internal combustion engine which has only one inlet valve per cylinder and in which at least one cylinder can be disengaged by shutting off its inlet valve.

I claim:

1. A valve gear mechanism for a multicylinder internal combustion engine comprising:

at least one inlet valve (E) per cylinder;

a camshaft including first cams (3 or 5) and second cams (4 or 6):

a common shaft (8) and first rocker arms (7) rotatable about said common shaft, and each of said first rocker arms operating in conjunction with an inlet valve and a first cam;

second rocker arms (9) rotatable about a common axis and each of which operates in conjunction with a second cam;

a coupling means for coupling adjacent ones of said first and second rocker arms;

said coupling means including a bore (11) in said first rocker arm and a bore (12) in said second rocker arm, and a coupling pin (13) movable between a first position in which said pin lies entirely in said first rocker arm bore (11) and a second position in which said pin extends into said second rocker arm bore (12) to couple said first and second rocker arms so said inlet valve is actuated in accordance with a profile of said second cam;

a pressure means;

at least one longitudinal channel (15) in communication with said pressure means, and an opening (16) for connecting said longitudinal channel to said first rocker arm bore to deliver a pressure medium from said pressure means to actuate said coupling pin; and wherein said first cams (3) have a zero-lift profile for all inlet valves (E1) of at least one cylinder; and plugs (25, 26) for sealing a section **(15*a*) of said longitudinal channel (15) connected to said first rocker arm bore in at least one first rocker arm which operates in conjunction with a cam (3)** with a zero-lift profile;

a high pressure source;

an on-off valve (28) connected to said high pressure source;

and a pressure medium delivery bore (27) for connecting said on-off valve and said longitudinal section **(15*a*)**, whereby connection between said section and said high pressure source is controlled by said on-off valve on the basis of engine operating parameters.

2. A valve gear mechanism as in claim 1 wherein said pressure medium delivery bore (27) is provided in one of said plugs (26) and said one plug is mounted in the area of a bearing point (32) of said common shaft (8) in a cylinder head of said internal combustion engine.

3. A valve gear mechanism for a multicylinder internal combustion engine comprising:

a plurality of inlet valves (E) per cylinder;

a camshaft including first cams (3 or 5) and second cams (4 or 6):

a common shaft (8) and first rocker arms (7) rotatable about said common shaft, and each of said first rocker arms operating in conjunction with an inlet valve and a first cam;

second rocker arms (9) rotatable about a common axis and each of which operates in conjunction with a second cam;

a coupling means for coupling adjacent ones of said first and second rocker arms;

said coupling means including a bore (11) in said first rocker arm and a bore (12) in said second rocker arm, and a coupling pin (13) movable between a first position in which said pin lies entirely in said first rocker arm bore (11) and a second position in which said pin extends into said second rocker arm bore (12) to couple said first and second rocker arms so said inlet valve is actuated in accordance with a profile of said second cam;

a pressure means;

and for at least one cylinder having first and second inlet valves, said common shaft (8) including a first longitudinal channel (33) in communication with said pressure means and a second longitudinal channel (34) in communication with said pressure means, and openings (16) for connecting said first longitudinal channel to a bore (11) in a first rocker arm **(7*a*, 7*c*) actuating a first inlet valve of said at least one cylinder and for connecting said second longitudinal channel to a bore (11) in a first rocker arm (7*b*) actuating a second inlet valve of said at least one cylinder to deliver a pressure medium from said pressure means to actuate said coupling pin; and wherein said first cams (3) have a zero-lift profile for all inlet valves (E1) of at least one cylinder; and means for sealing a section (33*a*, 34*a*) of each said longitudinal channel (33, 34) connected to first rocker arm bores in first rocker arms which operate in conjunction with a cam (3)** with a zero-lift profile;

a high pressure source;

a slide valve (28) connected to said high pressure source and movable within at least one end of each said channel section **(33*a*, 34*a*)** to a first position in which said slide valve isolates both said longitudinal channel sections from said high pressure source, a second position in which said slide valve connects one of said longitudinal channel sections to said high pressure source, and a third position in which said slide valve connects both said longitudinal channel sections to said high pressure source.

4. A valve gear mechanism as in claim 3 wherein a center and two outer inlet valves are provided for said at least one cylinder and wherein said section **(33*a*) of said first longitudinal channel (33) communicates with bores (11) of first rocker arms actuating both said outer inlet valves, and section (34*a*) of said second longitudinal channel (34) communicates with a bore (11)** of a first rocker arm actuating said center inlet valve.

5. A valve gear mechanism as in claims 3 or 4 including a low pressure source and wherein said slide valve (38) includes a channel (46) in communication with said low pressure source and both said longitudinal channel section **(33*a*, 34*a*)**.

* * * * *